US007763849B1

(12) United States Patent
Park

(10) Patent No.: US 7,763,849 B1
(45) Date of Patent: Jul. 27, 2010

(54) REFLECTING ION CYCLOTRON RESONANCE CELL

(75) Inventor: Melvin A. Park, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 265 days.

(21) Appl. No.: 12/113,813

(22) Filed: May 1, 2008

(51) Int. Cl.
*H01J 49/38* (2006.01)

(52) U.S. Cl. ..... 250/291; 250/282

(58) Field of Classification Search ..... 250/291, 250/281, 282, 290
See application file for complete search history.

(56) References Cited

U.S. PATENT DOCUMENTS 4,924,089 A * 5/1990 Caravatti ..... 250/290
4,931,640 A * 6/1990 Marshall et al. ..... 250/291
4,990,775 A * 2/1991 Rockwood et al. ..... 250/291
5,019,706 A * 5/1991 Allemann et al. ..... 250/291
5,572,035 A 11/1996 Franzen
5,880,466 A * 3/1999 Benner ..... 250/281
7,038,200 B2 * 5/2006 Nikolaev ..... 250/291
7,495,211 B2 2/2009 Franzen et al.

OTHER PUBLICATIONS

Pittman, et al., "A Novel Hybrid Instrument Using a Commercial Electrospray Ionization Source with a High-performance FTMS for Proteomics Applications", Proceedings of the 52nd ASMS Conference on Mass Spectrometry and Allied Topics, Tennessee, May 23-27, 2004.
Naito, et al., "Improvement of the Electric Field in the Cylindrical Trapped Ion Cell", Int. J. Mass Spectromety and Ion Processes, 120, pp. 179-192, (1992).
Amster, I.J., "Fourier Transform Mass Spectrometry", J. Mass Spectrometry, vol. 31, pp. 1325-1337, (1996).
Marshall, et al., "Fourier Transform Ion Cyclotron Resonance Mass Spectrometry: A Primer", Mass Spectrometry Reviews, 17, pp. 1-35, (1998).

* cited by examiner

*Primary Examiner*—Jack I Berman
(74) *Attorney, Agent, or Firm*—Law Offices of Paul E. Kudirka

(57) ABSTRACT

In a Fourier transform mass spectrometer, an ion cyclotron resonance cell includes trapping and reflecting electrodes. Ions are initially trapped via an electrostatic trapping field. After ions have been excited into a coherent cyclotron motion, the trapping field is turned off and the ions are contained using a reflecting field. The reflecting electrostatic field has substantially no radial field components and therefore introduces essentially no magnetron motion into the ion orbits.

16 Claims, 7 Drawing Sheets

REFLECTING ION CYCLOTRON RESONANCE CELL

BACKGROUND

The present invention generally relates to a measuring cell for an ion cyclotron resonance mass spectrometer (FTMS) and to methods for the analysis of samples by mass spectrometry. The apparatus and methods for ion transport and analysis described herein are enhancements of the techniques referred to in the literature relating to mass spectrometry—an important tool in the analysis of a wide range of chemical compounds. Specifically, mass spectrometers can be used to determine the molecular weight of sample compounds. The analysis of samples by mass spectrometry consists of three main steps—formation of gas phase ions from sample material, mass analysis of the ions to separate the ions from one another according to ion mass, and detection of the ions. A variety of means and methods exist in the field of mass spectrometry to perform each of these three functions. The particular combination of the means and methods used in a given mass spectrometer determine the characteristics of that instrument.

To mass analyze ions, for example, one might use magnetic (B) or electrostatic (E) analysis, wherein ions passing through a magnetic or electrostatic field will follow a curved path. In a magnetic field, the curvature of the path will be indicative of the momentum-to-charge ratio of the ion. In an electrostatic field, the curvature of the path will be indicative of the energy-to-charge ratio of the ion. If magnetic and electrostatic analyzers are used consecutively, then both the momentum-to-charge and energy-to-charge ratios of the ions will be known and the mass of the ion will thereby be determined. Other mass analyzers are the quadrupole (Q), the ion cyclotron resonance (ICR), the time-of-flight (TOF), the Orbitrap™, and the quadrupole ion trap analyzers. The analyzer used in conjunction with the method described here may be any of a variety of these.

Before mass analysis can begin, gas phase ions must be formed from a sample material. If the sample material is sufficiently volatile, ions may be formed by electron ionization (EI) or chemical ionization (CI) of the gas phase sample molecules. Alternatively, for solid samples (e.g., semiconductors, or crystallized materials), ions can be formed by desorption and ionization of sample molecules by bombardment with high energy particles. Further, Secondary Ion Mass Spectrometry (SIMS), for example, uses keV ions to desorb and ionize sample material. In the SIMS process a large amount of energy is deposited in the analyte molecules, resulting in the fragmentation of fragile molecules. This fragmentation is undesirable in that information regarding the original composition of the sample (e.g., the molecular weight of sample molecules) will be lost.

For more labile, fragile molecules, other ionization methods now exist. The plasma desorption (PD) technique was introduced by Macfarlane et al. (R. D. Macfarlane, R. P. Skowronski, D. F. Torgerson, *Biochem. Biophys. Res Commoun.* 60 (1974) 616)("McFarlane"). Macfarlane discovered that the impact of high energy (MeV) ions on a surface, like SIMS would cause desorption and ionization of small analyte molecules. However, unlike SIMS, the PD process also results in the desorption of larger, more labile species (e.g., insulin and other protein molecules).

Additionally, lasers have been used in a similar manner to induce desorption of biological or other labile molecules. See, for example, Cotter et al. (R. B. VanBreeman, M. Snow, R. J. Cotter, *Int. J. Mass Spectrom. Ion Phys.* 49 (1983) 35; Tabet, J. C.; Cotter, R. J., Tabet, J. C., *Anal. Chem.* 56 (1984) 1662; or R. J. Cotter, P. Demirev, I. Lys, J. K. Olthoff, J. K.; Lys, I.: Demirev, P.: Cotter et al., R. J., *Anal. Instrument.* 16 (1987) 93). Cotter modified a CVC 2000 time-of-flight mass spectrometer for infrared laser desorption of non-volatile biomolecules, using a Tachisto (Needham, Mass.) model 215G pulsed carbon dioxide laser. The plasma or laser desorption and ionization of labile molecules relies on the deposition of little or no energy in the analyte molecules of interest.

The use of lasers to desorb and ionize labile molecules intact was enhanced by the introduction of matrix assisted laser desorption ionization (MALDI) (K. Tanaka, H. Waki, Y. Ido, S. Akita, Y. Yoshida, T. Yoshica, *Rapid Commun. Mass Spectrom.* 2 (1988) 151 and M. Karas, F. Hillenkamp, *Anal. Chem.* 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process (i.e., MALDI) is typically used in conjunction with time-of-flight mass spectrometry (TOFMS) and can be used to measure the molecular weights of proteins in excess of 100,000 Daltons.

Further, Atmospheric Pressure Ionization (API) includes a number of ion production means and methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. This method allows for very large ions to be formed. Ions as large as 1 MDa have been detected by ESI in conjunction with mass spectrometry (ESMS).

In addition to ESI, many other ion production methods might be used at atmospheric or elevated pressure. For example, MALDI has recently been adapted by Laiko et al. to work at atmospheric pressure (Victor Laiko and Alma Burlingame, "Atmospheric Pressure Matrix Assisted Laser Desorption", U.S. Pat. No. 5,965,884, and Atmospheric Pressure Matrix Assisted Laser Desorption Ionization, poster #1121, $4^{th}$ International Symposium on Mass Spectrometry in the Health and Life Sciences, San Francisco, Aug. 25-29, 1998) and by Standing et al. at elevated pressures (Time of Flight Mass Spectrometry of Biomolecules with Orthogonal Injection+Collisional Cooling, poster #1272, $4^{th}$ International Symposium on Mass Spectrometry in the Health and Life Sciences, San Francisco, Aug. 25-29, 1998; and Orthogonal Injection TOFMS *Anal. Chem.* 71(13), 452A (1999)). The benefit of adapting ion sources in this manner is that the ion optics (i.e., the electrode structure and operation) in the mass analyzer and mass spectral results obtained are largely independent of the ion production method used.

Many different types of analyzers have been used to mass analyze sample ions. One important type of mass analyzer is the Fourier transform ion cyclotron (FTICR) mass analyzer. In FTICR-MS the mass-to-charge ratios m/z of ions are measured by their cyclotron movements in a homogeneous magnetic field with high field strength. The magnetic field is usually generated by superconductive magnetic coils cooled in liquid helium. Nowadays, such magnet coils provide usable cell diameters of around 6 to 12 centimeters at magnetic field strengths of 7 to 12 Tesla.

The orbital frequency of the ions (ion cyclotron frequency) is measured in ICR measuring cells located within the homogeneous part of the magnetic field. The ICR measuring cells normally comprise four longitudinal electrodes which extend in a cylindrical arrangement parallel to the magnetic field lines and surround the measuring cell like a sliced sleeve. Usually, two of these electrodes are used to bring ions, introduced close to the axis, into their cyclotron orbits (into their cyclotron motion), ions with the same mass-to-charge ratio being excited as in phase as possible in order to obtain a synchronously orbiting cloud of ions. The two other electrodes serve to measure the orbiting of the ion clouds by their image currents, which are induced in the electrodes as the ions fly past. The term "image currents" is normally used even though it is actually the induced "image voltages" which are measured. The processes of introducing the ions into the measuring cell, ion excitation and ion detection are carried out in successive steps of the method.

Since the mass-to-charge ratio of the ions (referred to below simply as "specific mass", and sometimes simply as "mass") before the measurement is unknown, the ions are excited by a complete and homogeneous mixture of excitation frequencies. This mixture can be a temporal mixture with frequencies increasing with time (called a "chirp"), or it can be a synchronous, computer-calculated mixture of all frequencies (a "sync pulse"). By specially selecting the phases, the synchronous mixture of the frequencies can be formed so that the amplitudes of the mixture remain restricted to the dynamic region of the digital-to-analog converter, which produces the temporal analog voltage sequence characteristics for the mixture.

The image currents induced by the ions in the detection electrodes are amplified, digitized and analyzed by Fourier analysis for the orbital frequencies present therein. The Fourier analysis transforms the original measurements in the "time domain" into a "frequency domain", hence the term Fourier transform mass spectrometry (FTMS). The specific masses of the ions and their intensities are then determined from the signals, which can be recognized as peaks in the frequency domain. Owing to the extraordinarily high constancy of the magnetic fields used, and the high accuracy for frequency measurements, it is possible to achieve an extraordinarily accurate mass determination. At present, Fourier transform mass spectrometry is the most accurate of all types of mass spectrometry. Ultimately, the accuracy depends only on the number of ion orbits which can be detected by the measurement.

The longitudinal electrodes usually form a measuring cell with a square or circular cross-section. The cylindrical measuring cell contains four cylinder segments as longitudinal electrodes. Cylindrical measuring cells are the ones most commonly used because they produce the best utilization of the magnetic field, although the image currents of focused clouds of ions with the same mass (image voltages) come close to a rectangular curve.

Since the ions can move freely in the direction of the magnetic field lines and possess, from the filling phase, all velocity components in the direction of the magnetic field, they must be prevented from leaving the measuring cell. To prevent ion losses, the measuring cells are therefore equipped at both ends with electrodes, known as "trapping electrodes". These are supplied with ion-repelling DC voltage potentials in order to keep the ions in the measuring cell. There are widely differing forms for this electrode pair, the simplest being planar electrodes with a central aperture. The aperture serves to introduce the ions into the measuring cell.

The vacuum in the measuring cell must be as good as possible because, during the measurement of the image currents, the ions should not collide with molecules of residual gas. Each collision of an ion with a molecule of residual gas brings the ion a bit out of the orbiting phase of the other ions with the same specific mass. The loss of phase homogeneity leads to a reduction in the image currents and to a continuous decrease in the signal-to-noise-ratio, which reduces the usable measuring period. The measurement period should amount to at least a few hundred milliseconds, ideally a few seconds. This requires a vacuum in the region of $10^{-7}$ to $10^{-9}$ Pascal.

Apart from the vacuum, the space charge in the ion cloud can also adversely affect the measurement. The Coulombic repulsion between the ions themselves and, above all, the elastic reflection of the ions moving in the cloud lead to a plurality of disturbances, which also lead to an expansion of the cloud. In present-day instruments, the space charge, alongside the effects of pressure, represents the greatest limitation on achieving a high mass accuracy.

For higher specific ion masses, the decrease in the cyclotron orbital frequency of the ions is inversely proportional to the mass. The resolution, however, is proportional to the number of measured orbits; it is therefore lower for ions of high specific masses than for those of low specific masses, although a high resolution and, correspondingly, a high mass accuracy is particularly desirably for ions of high masses. Since the introduction of ion cyclotron mass spectrometers, repeated attempts have been made to increase the resolution, particularly for higher specific ion masses, by using a larger number of detection electrodes to increase the frequency of the image currents in relation to the cyclotron frequency. If a total of sixteen detection electrodes are used instead of two, then the image currents are each measured sixteen times instead of two times, and the measured frequency increases by a factor of eight. It is to be expected that resolution and mass accuracy are also increased by a factor eight if measured over the same measuring time.

Unfortunately, these experiments have had only moderate success, and so they have regularly been abandoned. The reasons for the moderate success have not been adequately explained. It can be assumed that the ion clouds do not hold together well enough and that, for this reason, they cannot be brought close enough to the detection electrodes. Narrow electrodes require that the ion clouds are brought up very close to the detection electrodes, since otherwise it is scarcely possible to induce the image currents at full strength.

The ion-repelling potentials from the trapping plates form a potential well in the interior of the measuring cell, with a parabolic potential profile along the axis of the measuring cell. The potential profile is only weakly dependent on the shape of these electrodes. The potential profile along the axis is at its minimum at precisely the mid-point of the measuring cell if the ion-repelling potentials across both electrodes have the same value. The ions introduced will therefore execute oscillations in this potential well in the axial direction—so-called trapping oscillations—because they still possess kinetic energy in the axial direction from their introduction. The amplitude of the trapping oscillations depends on their kinetic energy.

The electric field outside the axis of the measuring cell is more complicated to describe. It inevitably contains field components in the radial direction which generate a second type of ion motion: magnetron circular motion. The magnetron gyration is also a circular motion about the axis of the measuring cell, but much slower than the cyclotron circular motion. The additional magnetron circular motion causes the mid-points of the cyclotron circular movements to gyrate around the axis of the measuring cell at the frequency of the magnetron motion, with the result that the trajectory of the ions describes a cycloidal motion.

The superposition of magnetron and cyclotron circular motion is an undesirable phenomenon which leads to a frequency shift in the cyclotron frequency. Furthermore, it leads to a reduction in the usable volume of the measuring cell. The measured frequency of ion motion (the "reduced cyclotron frequency") is shifted to lower frequencies relative to the unperturbed cyclotron frequency by an amount depending on the cell geometry, the potential on the trapping plates, the magnetic field strength, and the mass of the ion. A measuring cell without magnetron circular motion would be very advantageous because the unperturbed cyclotron frequency could be directly measured and no corrections would have to be applied.

Recently, measuring cells for ion cyclotron resonance mass spectrometry have been elucidated in which practically no magnetron circular motion can develop. (E. Nikolaev, Lecture at the International Mass Spectrometry Conference (IMSC) in Edinburgh, September 2003). In this case, the trapping electrodes are replaced with fine electrode structures, to which an RF voltage is applied and which thus reflect ions of both polarities because of their pseudopotential if the ions possess a specific mass above a mass threshold. The mass threshold can be adjusted by the RF voltage. Electrode structures of this type have been elucidated in U.S. Pat. No. 5,572,035 (J. Franzen). The pseudopotential has a very short range of the order of magnitude of the widths of the structural elements of this electrode structure. The reflection resembles a hard reflection on a matt screen, the scattering effect of the matt screen decreasing as the angle of incidence flattens out.

In U.S. patent application Ser. No. 11/243,510 J. Franzen et al. further the above concept of Nikolaev by applying only DC potentials to the above mentioned fine electrodes. In one embodiment, the fine electrodes take the form of a set of spokes radiating from the axis of the cell. Positive and negative DC potentials are applied to the spokes. The positive and negative potentials are of the same magnitude. The polarity of the DC potential applied to any given spoke is the opposite of that applied to adjacent spokes. The potentials applied to the spokes together with the cyclotron motion of ions in the cell may in some cases result in a pseudopotential that traps the ions in the cell. However, the methods of Nikolaev and Franzen have yet to be experimentally demonstrated and theoretically should work over only a limited mass range. Furthermore, such methods theoretically become less effective as the magnetic field strength is increased.

In other prior art FTICR instruments the above mentioned trapping plates are replaced by cylindrically shaped electrodes of the same inner diameter as the excite/detect electrodes. Ions are trapped by applying a repelling DC potential to the cylinder electrodes. In further prior art "auxiliary" electrodes are used to partially compensate for the effects of the electric field on ion cyclotron motion (A. M Brustkern et al., "A New Electrically Compensated Cylindrical ICR Trap: Procedure for Tuning and Improvements in Mass Resolving Power and Sensitivity", Proceedings of the 55$^{nd}$ ASMS Conference on Mass Spectrometry and Allied Topics, Indianapolis, Jun. 3-7, 2007. And Y. Naito, Improvement of the Electric Field in the Cylindrical Trapped Ion Cell, *Int. J. Mass Spectrom. Ion Processes* 120, p179 (1992).). These prior art methods have had limited success.

As discussed below, the reflecting ICR cell according to the present invention overcomes many of the limitations of prior art ICR cells discussed above. The ICR cell disclosed herein provides for the substantial elimination of the radial component of the trapping electric field and thus the magnetron motion of trapped ions.

SUMMARY

In accordance with one embodiment of the invention, an apparatus and method are provided for trapping and mass analyzing ions in an ICR cell. According to this embodiment, the apparatus includes a strong, homogeneous magnetic field and excitation and detection electrodes which taken together form a cylinder the axis of which is aligned with the magnetic field. At either end of, and axially aligned with, this central cylinder the apparatus includes a trapping plate and a set of reflecting electrodes designed to form an ion reflecting electrostatic field having nearly no radial component. Ions are introduced into the volume of the central cylinder via apertures in the reflecting electrodes and trapping plate. Initially, the ions are trapped via a DC potential applied to the trapping plates. The trapped ions are excited using the excitation electrodes into cyclotron motion at a predetermined radius about the axis of the ICR cell. The potential on the trapping plates are then set to ground potential and simultaneously, the reflecting electrodes are set to a predetermined potentials so as to form a reflecting field. The reflecting electrostatic field is designed to reflect ions which are near the predetermined cyclotron radius along the axis of the ICR cell into the volume of the central cylinder such that ions in the ICR cell do not escape along the magnetic field lines. Excited ions in the volume of the central cylinder are detected via the detection electrodes. The amplitude and frequency of the detected signals are used to construct a mass spectrum of the ions in substantially the same manner as in prior art FTICR instruments.

In accordance with another embodiment of the invention, an improved apparatus and method are provided for trapping and mass analyzing ions in an ICR cell. According to this embodiment, the apparatus includes a strong, homogeneous magnetic field and excitation and detection electrodes which taken together form a cylinder the axis of which is aligned with the magnetic field. At either end of, and axially aligned with, this central cylinder the apparatus includes a trapping plate and a set of reflecting electrodes designed to form an ion reflecting electrostatic field having a minimal radial component. Those reflecting electrodes which are axially aligned with the detection electrodes are used for ion detection as well as for forming the reflecting field. These reflecting/detecting electrodes may be capacitively coupled to the detection electrodes of the central cylinder. Ions are introduced into the volume of the central cylinder via apertures in the reflecting electrodes and trapping plates. Initially, the ions are trapped via a DC potential applied to the trapping plates. The trapped ions are excited using the excitation electrodes into cyclotron motion at a predetermined radius about the axis of the ICR cell. The potential on the trapping plates are then set to ground and simultaneously, the reflecting electrodes are set to a predetermined potential. The reflecting electrostatic field is designed to reflect ions near the predetermined cyclotron radius along the axis of the ICR cell into the volume of the central cylinder such that ions in the ICR cell do not escape along the magnetic field lines. Excited ions are detected via the detection and reflection/detection electrodes. The amplitude and frequency of the detected signals are used to construct a mass spectrum of the ions in substantially the same manner as in prior art FTICR instruments.

In accordance with yet another embodiment of the invention, an apparatus and method are provided for trapping and mass analyzing ion in an ICR cell wherein the measured ion signal is a higher order multiple of the fundamental ion cyclotron frequency. According to this embodiment, the apparatus includes a strong, homogeneous magnetic field and excitation and a multitude of pairs of detection electrodes. Taken together, the excitation and detection electrodes form a cylinder the axis of which is aligned with the magnetic field. The detection electrodes are spaced at regular intervals about the axis such that the frequency of the detected signal is the fundamental ion cyclotron frequency times the number of detection electrodes pairs. At either end of, and axially aligned with, this central cylinder the apparatus includes a trapping plate and a set of reflecting electrodes designed to form an ion reflecting electrostatic field having a minimal radial component. Ions are introduced into the volume of the central cylinder via apertures in the reflecting electrodes and trapping plates. Initially, the ions are trapped via a DC potential applied to the trapping plates. The trapped ions are excited using the excitation electrodes into cyclotron motion at a predetermined radius about the axis of the ICR cell. The potential on the trapping plates are then set to ground potential and simultaneously, the reflecting electrodes are set to a predetermined potential. The reflecting electrostatic field is designed to reflect ions near the predetermined cyclotron radius along the axis of the ICR cell into the volume of the central cylinder such that ions in the ICR cell do not escape along the magnetic field lines. Excited ions in the volume of the central cylinder are detected via the detection electrodes. The amplitude and frequency of the detected signals are used to construct a mass spectrum of the ions in substantially the same manner as in prior art FTICR instruments.

BRIEF DESCRIPTION OF THE DRAWINGS

For a more complete understanding of the present invention, reference is now made to the following drawings in which.

DETAILED DESCRIPTION

As discussed above, the present invention relates generally to mass spectrometry and more particularly to the FTICR mass spectroscopic analysis of chemical samples. Reference is herein made to the figures, wherein the numerals representing particular parts are consistently used throughout the figures and accompanying discussion.

Figure 1:
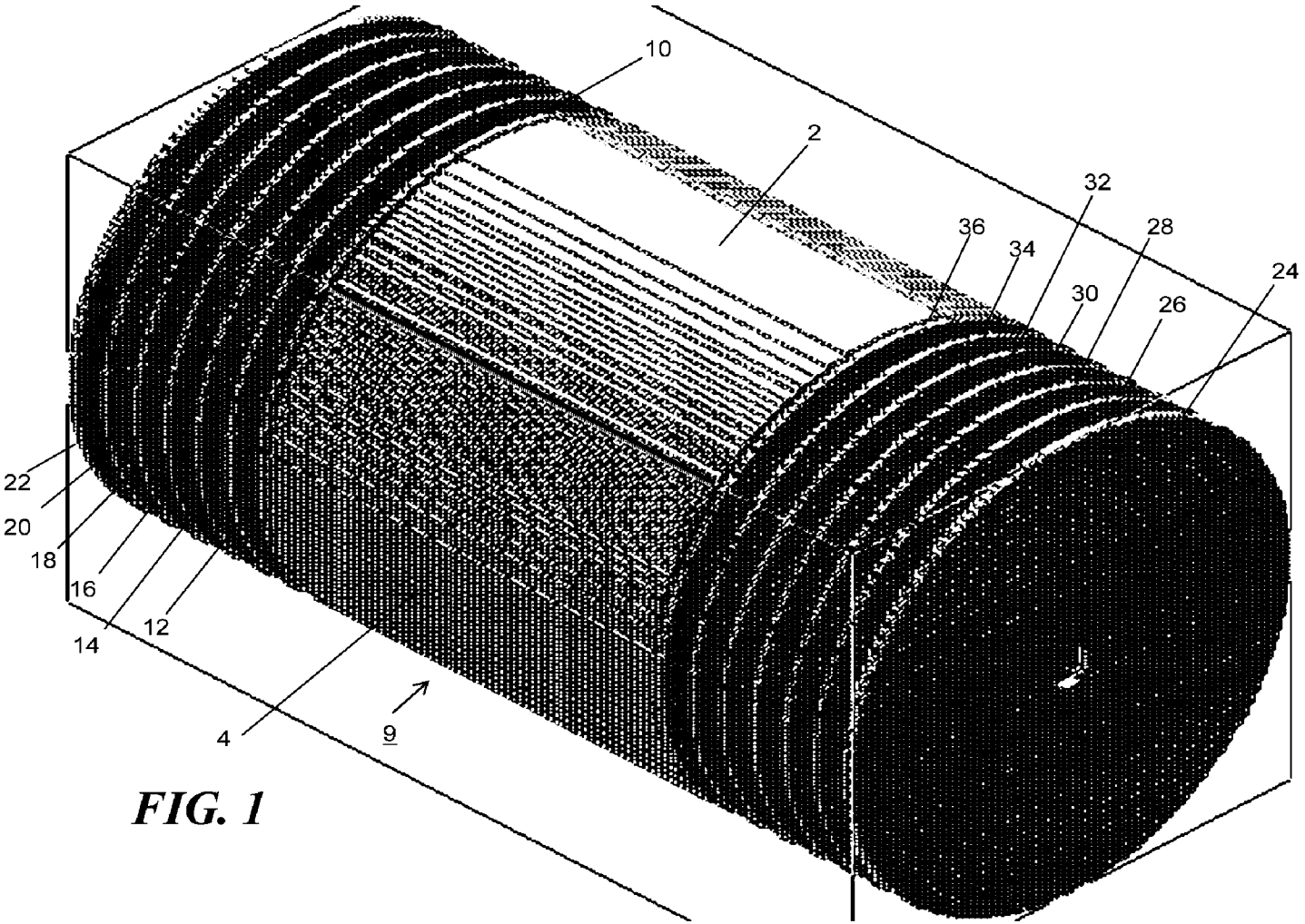
FIG. 1 depicts a reflecting ICR cell according to the present invention having trapping plates and reflecting electrodes on either end of a central cylinder.
Figure 2:
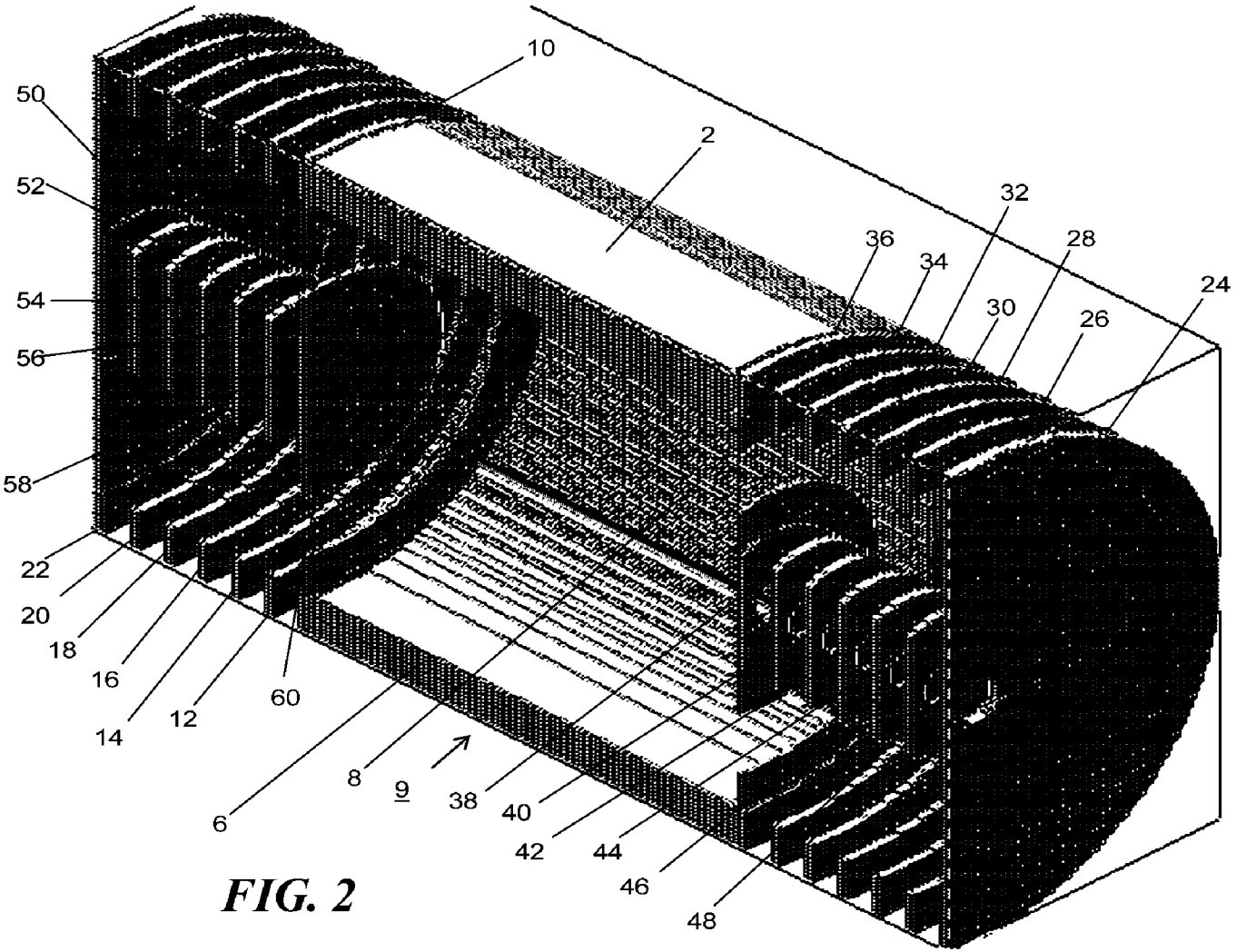
FIG. 2 is a cut-away view of the reflecting ICR cell of FIG. 1.

FIG. 1 depicts a reflecting ICR cell according to the present invention. FIG. 2 is a cut-away view of the reflecting ICR cell of FIG. 1. As shown, reflecting ICR cell 1 includes a pair of excitation electrodes 4 and 8 and a pair of detection electrodes 2 and 6. Electrodes 2, 4, 6, and 8 are formed and positioned about an axis so as to form substantially cylindrical structure 9. In alternate embodiments planar excitation and detection electrodes may be used. The dimensions of electrodes 2, 4, 6, and 8 and central cylinder 9 may be any desired dimensions, however, as an example, cylinder 9 has an inner diameter of 60 mm and a length of 62 mm. The outer diameter of cylinder 9 is 71 mm. Each of electrodes 2, 4, 6, and 8 cover 89° of arc about the axis of cylinder 9. The axis of cylinder 9 is substantially aligned with a homogeneous, strong magnetic field. In alternate embodiments electrodes 2-8 may be thinner and may have a larger gap between them so as to minimize the capacitive coupling between them.

Central cylinder 9 is bounded by inner trapping plates 38 and 60 and outer trapping plates 10 and 36. Trapping plates 10, 36, 38, and 60 have electrically conducting, planar surfaces. The dimensions of inner trapping plates 38 and 60 may be any desired dimension, however, as an example, the diameter and thickness of trapping plates 38 and 60 are 31 and 2 mm respectively. The dimensions of outer trapping plates 10 and 36 may be any desired dimension, however, as an example, the inner diameter, outer diameter, and thickness of plates 10 and 36 are 49, 71, and 2 mm respectively. Trapping plates 10, 60, 36, and 38 are cylindrically symmetric and centered on the same axis as cylinder 9. The gap between trapping plate 10 and cylinder 9 and between plate 36 and cylinder 9 is 1 mm; however, in alternate embodiments any desired gap may be used.

The volume of reflecting ICR cell 1 is further bounded by outer reflecting electrodes 12, 14, 16, 18, 20, 22, 24, 26, 28, 30, 32, and 34, and inner reflecting electrodes 40, 42, 44, 46, 48, 50, 52, 54, 56, and 58. Outer reflecting electrodes 12, 14, 16, 18, 20, 22, 24, 26, 28, 30, 32, and 34 may be of any dimensions, however, as an example, their inner diameter, outer diameter, and thickness is 60, 71, and 2 mm respectively. Inner reflecting electrodes 40, 42, 44, 46, 48, 50, 52, 54, 56, and 58 may be of any dimensions, however, as an example, their diameter and thickness is 20 and 2 mm respectively. Reflecting electrodes 12-34, and 40-58 are all electrically conducting and centered on the axis of cylinder 9. The gap between adjacent reflecting electrodes 12-34 and 40-58 is 4 mm, however, in alternate embodiments, any length gap may be used. In alternate embodiments, the gap between adjacent reflecting electrodes may vary as a function of position along their common axis. In alternate embodiments more or fewer reflecting electrodes may be used.

Elements 2-60 are fixed in cell 1 via a set of electrically insulating rods and spacers (not shown). Such means and methods of mounting elements in assemblies are well known in the prior art. To mount inner reflecting electrodes 40-48 and reflecting electrode 24 into cell 1, four 3.05 mm diameter holes (not shown) are made in each element. These four holes are spaced symmetrically about the axis of cell 1 at a radius of 6.5 mm from the axis. The holes in adjacent elements are aligned with each other such that four ceramic rods (not shown) of 3 mm diameter can be fitted through the plates one rod per hole. Trapping plate 38 has four corresponding M3 threaded holes in it. The above-mentioned ceramic rods are threaded on either end. One end of each ceramic rod is screwed into one of the four threaded holes in trapping plate 38. Ceramic spacers (not shown) are placed on the rods between adjacent elements to define the gaps between the elements. The ceramic spacers are cylindrically symmetric having an inner diameter of 3.05 mm, an outer diameter of 5 mm, and a length of 4 mm. The thread of the above mentioned ceramic rods extend through plate 24 and nuts are screwed onto these threads to fix reflecting plates 40-48 and 24 to inner trapping plate 38.

An additional 3 mm hole is made in elements 24 and 40-48 at a radius of 6.5 mm from the axis of cell 1. The additional 3 mm holes on adjacent elements are aligned such that one or more wires may pass through these holes in order to bring electric potentials to elements 38-48.

To mount inner reflecting electrodes 50-58 and reflecting electrode 22 into cell 1, four 3.05 mm diameter holes (not shown) are made in each element. These four holes are spaced symmetrically about the axis of cell 1 at a radius of 6.5 mm from the axis. The holes in adjacent elements 50-58 and 22 are aligned with each other such that four ceramic rods (not shown) of 3 mm diameter can be fitted through the plates—one rod per hole. Trapping plate 60 has four corresponding M3 threaded holes in it. The above mentioned ceramic rods are threaded on either end. One end of each ceramic rod is screwed into one of the four threaded holes in trapping plate 60. Ceramic spacers (not shown) are placed on the rods between adjacent elements to define the gaps between the elements. The ceramic spacers are cylindrically symmetric having an inner diameter of 3.05 mm, an outer diameter of 5 mm, and a length of 4 mm. The thread of the above mentioned ceramic rods extend through plate 22 and nuts are screwed onto these threads to fix reflecting plates 50-58 and 22 to inner trapping plate 60.

An additional 3 mm hole is made in elements 22 and 50-58 at a radius of 6.5 mm from the axis of cell 1. The additional 3 mm holes on adjacent elements are aligned such that one or more wires may pass through these holes in order to bring electric potentials to elements 50-60.

In a similar manner, elements 2-36 are mounted into cell 1 via a set of electrically insulating rods and spacers. Each electrode 2, 4, 6, and 8 has two M3 threaded holes made in either end of the electrodes. A threaded, 3 mm diameter ceramic rod is screwed into these holes—for a total of four rods per electrode. Adjacent elements 10-36 have eight corresponding through holes in them (not shown) such that the above mentioned ceramic rods can pass through these elements. Ceramic spacers are placed on the rods between adjacent elements to define the gaps between the elements. The ceramic spacers are cylindrically symmetric having an inner diameter of 3.05 mm, an outer diameter of 5 mm, and a length of 4 mm. The length of the ceramic spacers between elements 2-8 and trapping plate 36 is 1 mm. Similarly, The length of the ceramic spacers between elements 2-8 and trapping plate 10 is 1 mm, On one end of cell 1, the thread of the above mentioned ceramic rods extend through plate 24 and nuts are screwed onto these threads to fix reflecting plates 24-34 and trapping plate 36 to excite and detect electrodes 2-8. On the opposite end of cell 1, the thread of the above mentioned ceramic rods extend through plate 22 and nuts are screwed onto these threads to fix reflecting plates 12-22 and trapping plate 10 to excite and detect electrodes 2-8.

In alternate embodiments, the ceramic rods are not threaded and are fixed in place using epoxy. In other alternate embodiments, any electrically insulating material may be used instead of ceramic. In further alternate embodiments, the rods and/or spacers may be placed in any desired position so long as such placement results in a rigid assembly so that trapping plates 10, 60, 36, and 38 and reflecting elements 12-34 and 40-58 do not vibrate excessively during operation. The placement of the insulating rods and spacers must also be such that the electrostatic field in cell 1 is not substantially disturbed by the presence of the rods and/or spacers or any electrical charge buildup on the surface of the rods or spacers. In alternate embodiments, elements 10-60 may be thicker so as to reduce the gap between adjacent elements and thereby reduce the influence of the spacers on the electric field in cell 1.

In still further alternate embodiments, elements 10-60 may be mounted by any known means whereby trapping plates 10, 60, 36, and 38 and reflecting elements 12-34 and 40-58 are held rigidly in place and whereby the mounting means does not substantially disturb the electrostatic field in cell 1.

In yet other alternate embodiments, reflecting electrodes 12-34 and 40-58 may be replaced by insulating cylinders having an electrically resistive coating along their surfaces or by resistive glass cylinders (see, for example, Photonis, Inc., Sturbridge, Mass.).

An experimental method according to the present invention consists of the steps of:

a. generating ions;
b. introducing ions into the reflecting ICR cell;
c. trapping ions in the ICR cell;
d. exciting trapped ions into cyclotron motion of approximately a predetermined radius;
e. turning off the trapping potentials;
f. applying the reflecting potentials;
g. and detecting the ions.

ICR cell 1 is operated in a high vacuum environment, for example, $1^{-10}$ mbar. Ions are generated from sample material in an ion source outside cell 1 and are introduced into cell 1 via apertures in reflecting electrodes 40-48, 24, and trapping plate 38. The apertures may be any desired diameter; however, as an example the apertures are 6 mm in diameter. The apertures in reflecting electrodes 24, 40-48, and trapping plate 38 are centered on the same axis as cylinder 9. The ion source may include any known method of generating ions from sample material including but not limited to electrospray ionization, laser desorption, matrix assisted laser desorption ionization, chemical ionization, atom bombardment, or ion bombardment. In alternate embodiments, ions may be generated inside cell 1.

Figure 3:
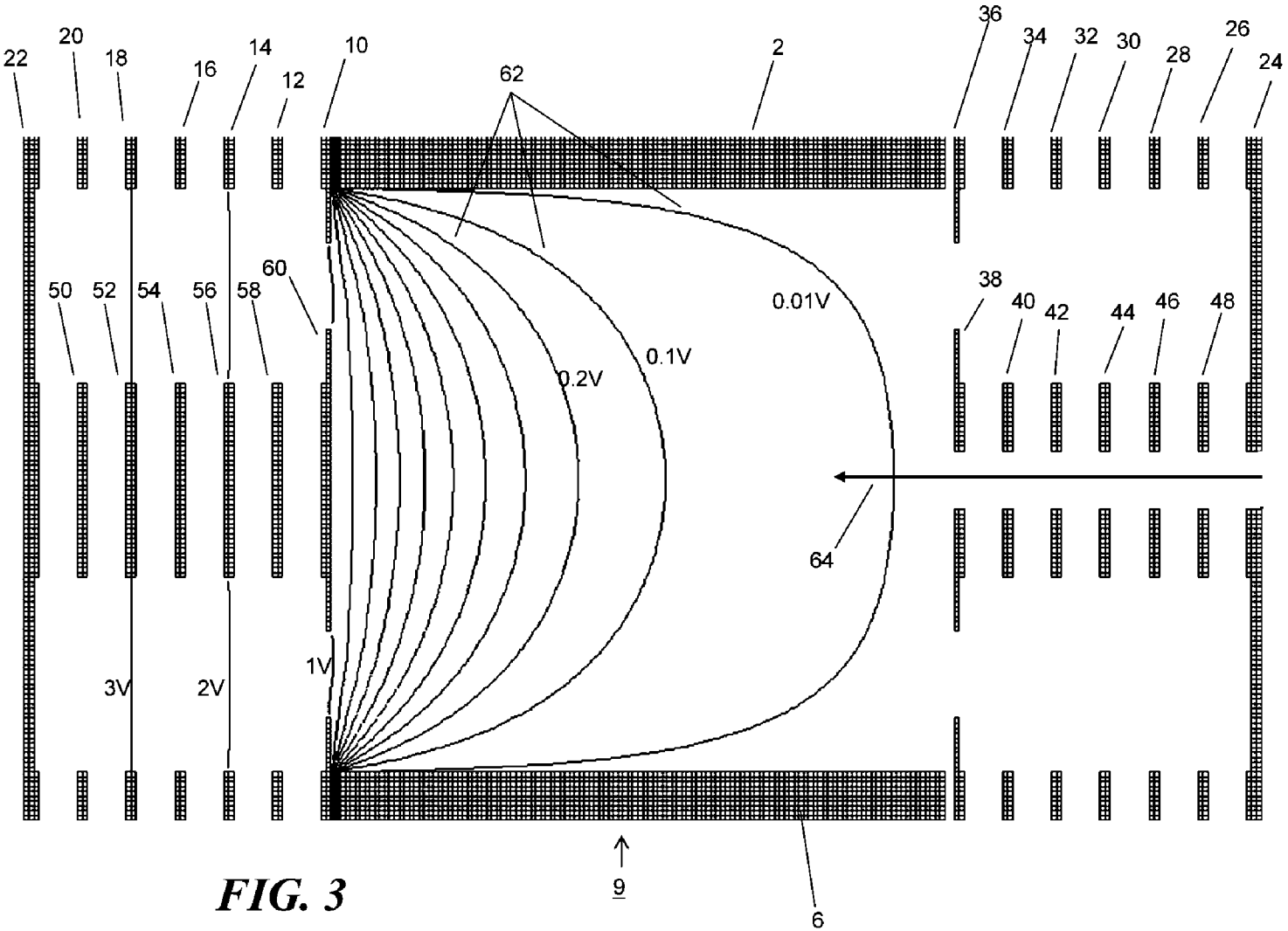
FIG. 3 depicts a simulation of the reflecting ICR cell of FIG. 1 showing the equipotential lines during the introduction of ions.

FIG. 3 is the result of a simulation of cell 1 potentials during ion injection. During step b) "injection", electrodes 2, 4, 6, and 8, trapping plates 36 and 38 and reflecting electrodes 24-34 and 40-48 are all held at ground potential. Trapping plates 10 and 60 are held at a potential of 1 V. Reflecting electrode 22 is held at a potential of 4V. The remaining reflecting electrodes 12-20 and 50-58 are held at DC potentials required to produce a substantially constant electric field strength in the region between electrode 22 and trapping plates 10 and 60. The potentials on electrodes 12, 14, 16, 18 and 20 are 1.5, 2, 2.5, 3, and 3.5 V respectively. Similarly, the potentials on electrodes 58, 56, 54, 52, and 50 are 1.5, 2, 2.5, 3, and 3.5V respectively. For convenience, the potentials on electrodes 12-20 and 50-58 may be applied via a resistor divider. The potentials applied as above will result in an electrostatic field in cylinder 9 having equipotential surfaces represented by lines 62. In alternate methods, any of the above potentials may be set to any desired value so as to generate any of a wide variety of possible electrostatic fields.

Ions enter cell 1 along the axis of the cell and path 64. In accordance with the present method, the majority of the ions have a kinetic energy of 1 eV or less when entering cell 1. The electrostatic field in cylinder 9 decelerates the ions and then accelerates them back along the axis of the cell towards trapping plate 38. Before the ions exit cell 1 via the apertures in electrodes 24 and 38-48 the potentials on reflecting electrodes 24-48 are changed so as to produce the trapping electrostatic field represented in FIG. 4.

In alternate embodiments, the kinetic energy of ions entering cell 1 may be greater than 1 eV, and the potentials applied to plates 10 and 60 will be similarly higher so as to reflect the ions. In further alternate embodiments plates 10 and 60 may be held at a potential such that the ions collide with plate 60 for the purpose of surface induced dissociation.

In further alternate embodiments electrodes 50-58 and plate 60 may be apertured such that ions entering cell 1 may pass through electrodes 50-58. According to this alternate embodiment, apertures on electrodes 50-58 and plate 60 are centered on the axis of cell 1. In such an embodiment the potentials on electrodes 12-22, 50-58, and plates 10 and 60 may be adjusted so as to form an electrostatic field that allows ions to pass through electrodes 50-58 before being reflected back towards plate 38. This embodiment has the advantage that the time required for the ions to be reflected is longer and therefore a longer filling time—i.e. the time between the initial introduction of ions and the exit of reflected ions back out of the cell—is possible. A longer filling time can result in a greater number of ions trapped in the cell and a broader trapped ion mass range.

In further alternate embodiments, "sidekick" electrodes may be included in either or both plates 38 or 24. Sidekick electrodes are described in detail in U.S. Pat. No. 4,924,089 which is incorporated herein by reference. Sidekick electrodes may be used during ion injection into cell 1 so as to reduce the axial kinetic energy of ions entering the cell. Electrodes on either side of ion path 64 are used to produce an electric field normal to the magnetic field. By this electric field, the ions are deflected onto a path normal to the magnetic field and the axial kinetic energy is converted to cyclotron motion.

Figure 4:
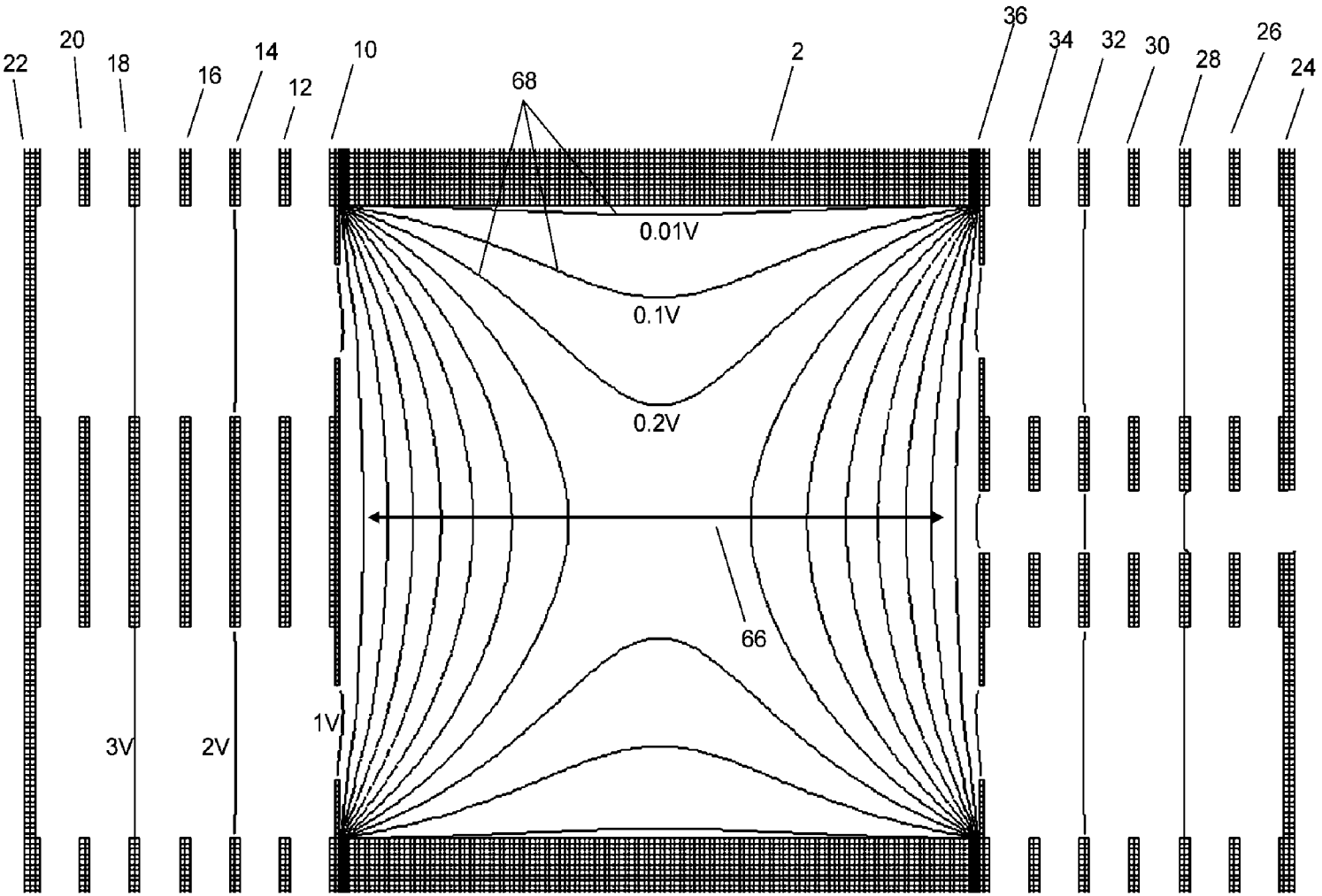
FIG. 4 depicts a simulation of the reflecting ICR cell of FIG. 1 showing the equipotential lines during the initial trapping of ions.

During step c) "trapping" the electrodes of cell 1 are used to generate a trapping field as depicted in FIG. 4. Electrodes 2, 4, 6, and 8 are held at ground potential. Trapping plates 10, 60, 36, and 38 are held at a potential of 1 V. Reflecting electrodes 22 and 24 are held at a potential of 4V. The remaining reflecting electrodes 12-20 and 50-58 and electrodes 26-34 and 40-48 are held at DC potentials required to produce a substantially constant electric field strength in the regions between electrode 22 and trapping plates 10 and 60 and between electrodes 24 and trapping plates 36 and 38. The potentials on electrodes 12, 14, 16, 18 and 20 are 1.5, 2, 2.5, 3, and 3.5 V respectively. Similarly, the potentials on electrodes 58, 56, 54, 52, and 50 are 1.5, 2, 2.5, 3, and 3.5V respectively. The potentials on electrodes 34, 32, 30, 28 and 26 are 1.5, 2, 2.5, 3, and 3.5 V respectively. Similarly, the potentials on electrodes 40, 42, 44, 46, and 48 are 1.5, 2, 2.5, 3, and 3.5V respectively. For convenience, the potentials on electrodes 12-20, 26-34, and 40-58 may be applied via a resistor divider. The potentials applied as above will result in an electrostatic field in cylinder 9 having equipotential surfaces represented by lines 68. In alternate methods, any of the above potentials may be set to any desired value so as to generate any of a wide variety of possible electrostatic fields.

During trapping, ions in cell 1 will have a cyclotron motion of small radius—i.e. less than or about 1 mm in diameter—in the plane normal to the magnetic field and therefore the axis of the cell. The ions will also have a motion along the axis of cell 1, however, the electrostatic field established as detailed above will continually reflect the ions back and forth between electrodes 38 and 60 along path 66.

Once trapped, the ions are excited into a coherent cyclotron motion of relatively large radius (step d above). The ions are excited by applying an RF potential between excitation electrodes 4 and 8. The frequency of the applied RF potential should be the same as the frequency of the cyclotron motion of the ions to be excited. If an ion population having more than a single cyclotron frequency is to be excited, then an RF potential incorporating a corresponding multitude of frequencies may be applied between electrodes 4 and 8. The amplitude and duration of the RF waveform at each frequency should be selected so as to excite all ions of interest to a similar cyclotron orbital radius. The cyclotron orbital radius may be any desired radius, however, according to the present embodiment, the orbital radius is 20+/−5 mm corresponding to the gap between trapping electrodes 36 and 38. The details of ion excitation are well known in the prior art.

Figure 5:
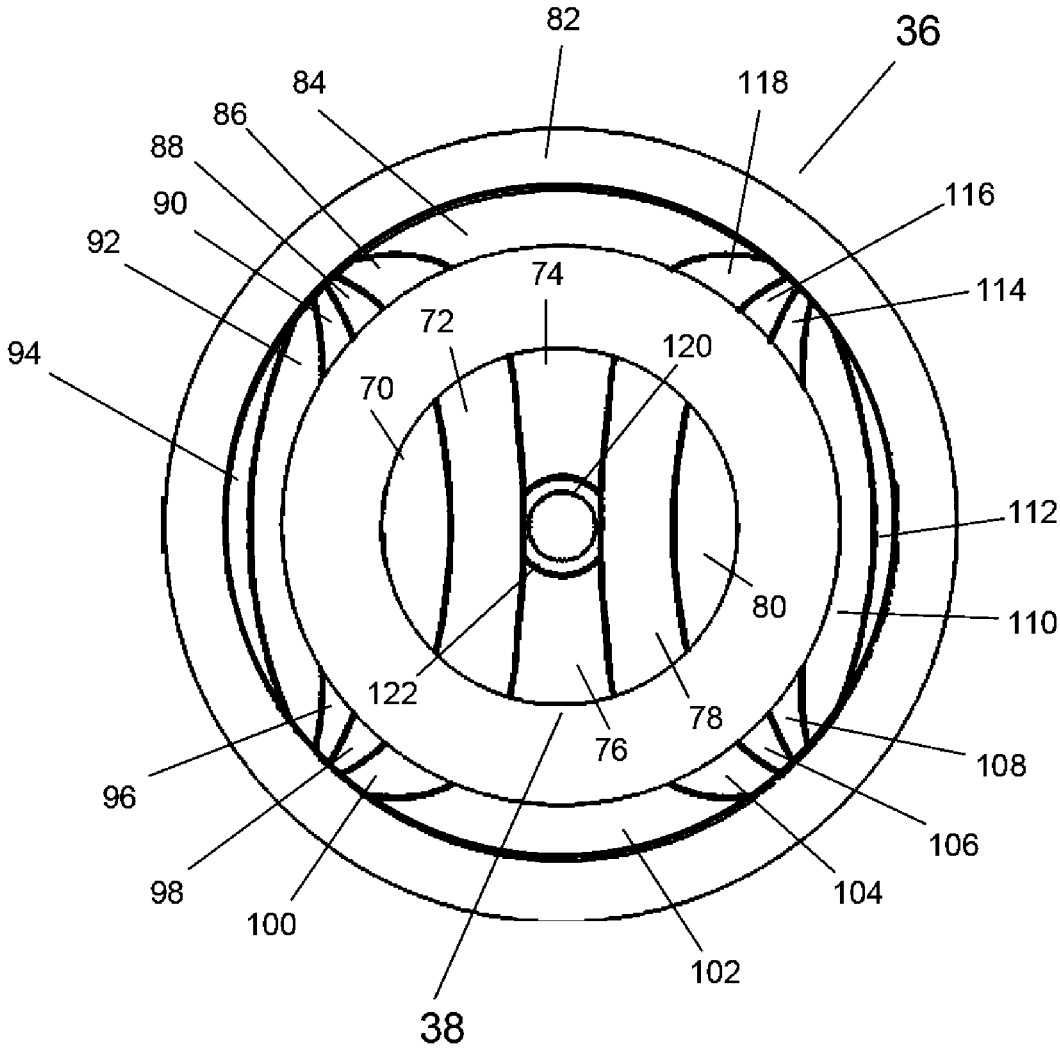
FIG. 5 depicts inner and outer trapping plates according to the present invention including an infinity pattern and sidekick electrodes.

In alternate embodiments, trapping plates 36, 38, 10 and 60 may be comprised of a multitude of electrodes. As depicted in FIG. 5 for plates 36 and 38 the electrodes 70-118 may be formed and assembled so as to produce an "infinity pattern". Electrodes 70-118 may take the form of a metal vapor deposit or thin metal plates bound to a ceramic plate. As detailed by Allemann and Caravatti in U.S. Pat. No. 5,019,706, incorporated herein by reference, the electrodes of an infinity pattern can be used to " . . . minimize the components of the electric RF field directed in parallel to the axis which act upon the ions in the measuring cell." During ion excitation, the excitation RF is divided and superimposed onto the trapping potential of electrodes 70-118 such that one obtains excitation RF field lines corresponding approximately to that which would be obtained, theoretically, in a cell of infinite axial length. This prevents the axial acceleration of the ions in cell 1 by the excitation RF field, which would otherwise normally result in these ions being lost before the detection step. Notice also in the alternate embodiment of FIG. 5 the incorporation of sidekick electrodes 120 and 122 in trapping plate 38. As discussed above these electrodes may be used to enhance the trapping of ions during the initial ion injection.

After excitation, the trapping potentials are turned off—i.e. the electrodes of trapping plates 10, 60, 36, and 38 are set to ground potential—and the reflecting potentials are applied in accordance with steps e) and f) above. In steps f) and g) the potentials applied to reflecting electrodes 12-22, 26-34, and 40-58 are such that substantially uniform electric fields having little or no radial component are formed in the regions bounded by the reflecting electrodes. The electric field strength is set so that ions trapped in cell 1 can penetrate into the regions bounded by reflecting electrodes 12-22, 26-34, and 40-58 and then be reflected by the electric field back into central cylinder 9.

The potentials on electrodes 12-22, 26-34, and 40-58 may be any of a wide variety of potentials, however, as an example, the potential on electrodes 22 and 24 is 1 V. The potential on electrodes 20, 26, 48, and 50 is 0.83 V. The potential on electrodes 18, 28, 46, and 52 is 0.67 V. The potential on electrodes 16, 30, 44, and 54 is 0.5 V. The potential on electrodes 14, 32, 42, and 56 is 0.33 V. And the potential on electrodes 12, 34, 40, and 58 is 0.17 V.

Figure 6:
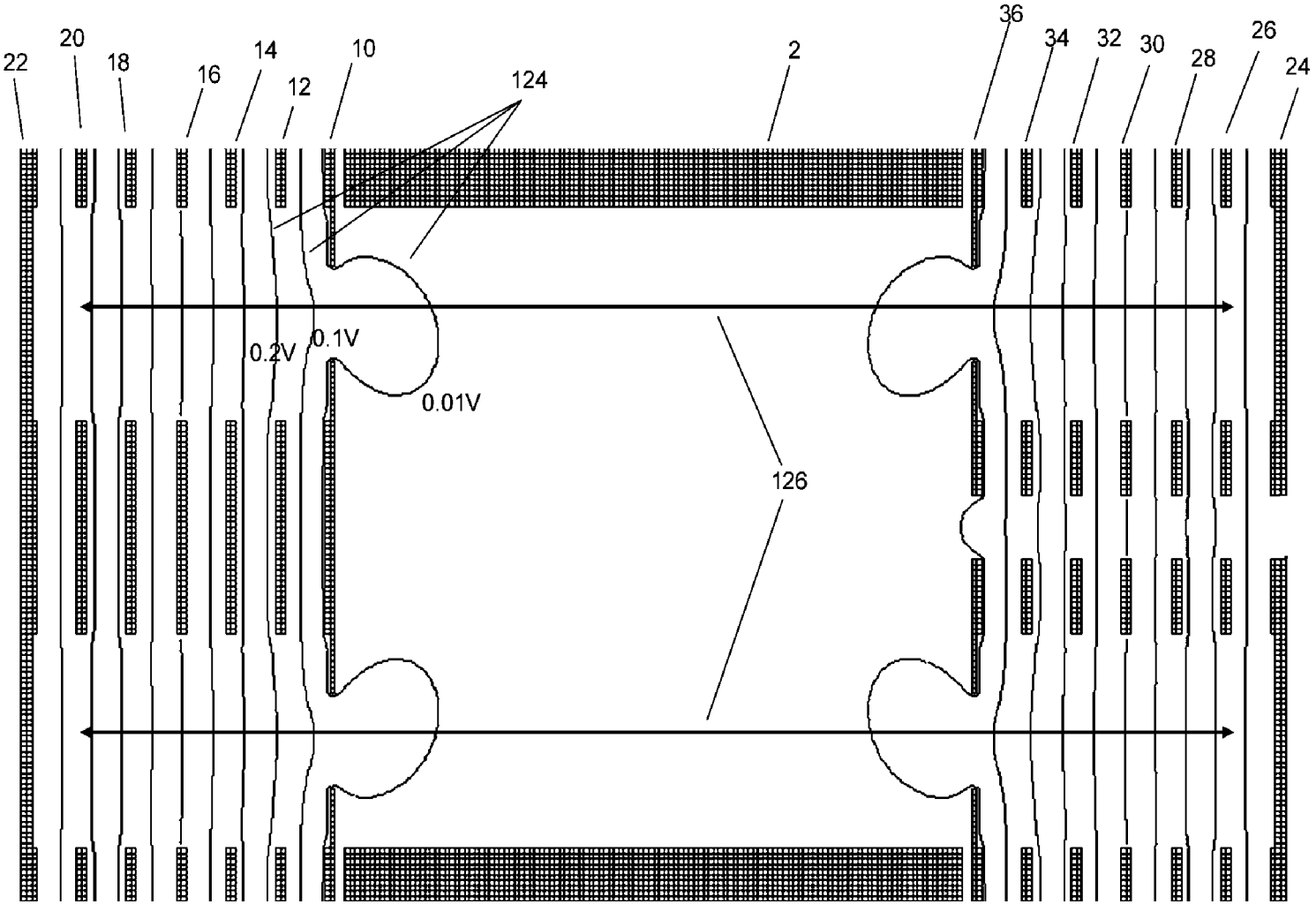
FIG. 6 depicts a simulation of the reflecting ICR cell of FIG. 1 showing the equipotential lines during the detection of ions.

Applying the potentials as given above results in the electric field represented in FIG. 6. FIG. 6 is the result of a simulation of cell 1 given the above applied potentials. The resulting equipotential surfaces of the electric field are represented by lines 124. Notice that cylinder 9 is nearly field free and that the reflecting electric fields in the regions defined by electrodes 12-34, and 40-58 are homogeneous and have nearly no radial component.

As described above with respect to step d) the ions were excited to a cyclotron orbital radius coincidental with the gaps between trapping plates 36 and 38 and between trapping plates 10 and 60. In the plane normal to the axis of cell 1, the ion describe a circular orbit. The ions also have some motion along the axis. In steps c) and d) the trapping electrostatic field restricted the axial motion of the ions to the space between trapping plates 36, 38, 10, and 60. However, in steps f) and g) given the electrostatic field depicted in FIG. 6, the ions may move axially into the volume defined by reflecting electrodes 12-34, and 40-58. When in this volume, the ions are decelerated, reflected, and reaccelerated back towards central cylinder 9. The ions thus describe a helical path along an imaginary cylindrical surface 126 and are restricted to the space between electrodes 22 and 24.

The ratio of the time any given ion spends in central cylinder 9 to the time it spends in the reflecting region defined by electrodes 12-34 and 40-58 is approximately $qEd/4\epsilon$ where q is the ion's charge, E is the reflecting electric field strength, d is the length of central cylinder 9, and $\epsilon$ is the axial kinetic energy of the ion when in the field free region of cylinder 9. Given the electrodes and potentials described above, an ion having a single positive charge and nearly 1 eV of kinetic energy would spend approximately 33% of its time in cylinder 9. The implication is that the signal intensity resulting from this ion during the detection step will be reduced by 66% relative to prior art cells. However, the trapped ions will have a distribution of kinetic energies. Within this distribution, ions having 0.5 eV or less of axial kinetic energy will spend more than 50% of their time in cylinder 9.

Notice again that there is only a negligible radial component to the reflecting field. Thus, once the trapping field is turned off and the reflecting field is established, the ions should have no magnetron motion. The elimination of the magnetron motion allows for the direct measurement of the unshifted ion cyclotron frequency.

Finally, once the reflecting fields have been established, the ions signals are measured in step g). The image currents on electrodes 2 and 6 are measured differentially to produce a transient. The signal frequencies and amplitudes are indicative of the trapped ion masses and abundances respectively. The measurement, deconvolution, and further analysis of signals from ICR cells is well established in the prior art.

In alternate embodiments, ion signals may be measured without turning off trapping plates 36, 38, 10, and 60. In one such embodiment, the trapping field as described with respect to FIG. 4 may be maintained throughout the detection step. This would result in a behavior and performance similar to prior art cells. That is, the signal intensities, frequencies, ion magnetron and cyclotron motion would all be similar to that of prior art designs. Alternatively, the trapping field may be only reduced—i.e. not to zero—when the reflecting field is established.

In alternate embodiments reflecting electrodes 12-20 and 26-34 may be segmented into quadrants. The quadrants of the reflecting electrodes are aligned with the quadrants of central cylinder 9. Those quadrants of electrodes 12-20 and 26-34 which are angularly aligned with electrode 2 are capacitively linked to detection electrode 2. And those quadrants of electrodes 12-20 and 26-34 which are angularly aligned with electrode 6 are capacitively linked to detection electrode 6. In this manner while the ions are in the reflecting field they can still be detected—i.e. via the charge induced on the quadrants of the reflecting electrodes.

In further alternate embodiments reflecting electrodes 12-20 and 26-34 may be cut into quadrants, capacitively coupled to detection electrodes 2 and 6 as described above, and tapered to a sharp edge toward the interior of the cell. Also according to this embodiment, the inner diameter of electrodes 12-20 and 26-34 is reduced so that ions pass close to electrodes 12-20 and 26-34 during the ion detection step. This has the effect to increase the signal detected via the reflecting electrodes.

In another alternate embodiment, reflecting electrodes 12-20 and 26-34 may be segmented into any even number of segments. According to this embodiment, segments adjacent to one another along the cell axis are capacitively coupled to one another but not to detection electrodes 2 and 6. Each set of capacitively coupled segments is used as a detection electrode during the ion detection step. If the reflecting electrodes 12-20 and 26-34 are divided into eight segments, then eight detection electrodes will be formed. These detection electrodes are then used in the manner described by Rockwood et al. in U.S. Pat. No. 4,990,775, herein incorporated by reference. In addition to forming the reflecting field, the reflecting electrodes 12-20 and 26-34—segmented and capacitively coupled—are used to detect higher order harmonics of the fundamental cyclotron frequency. Signals, so detected, will provide a higher mass resolving power in a given measurement time.

Figure 7:
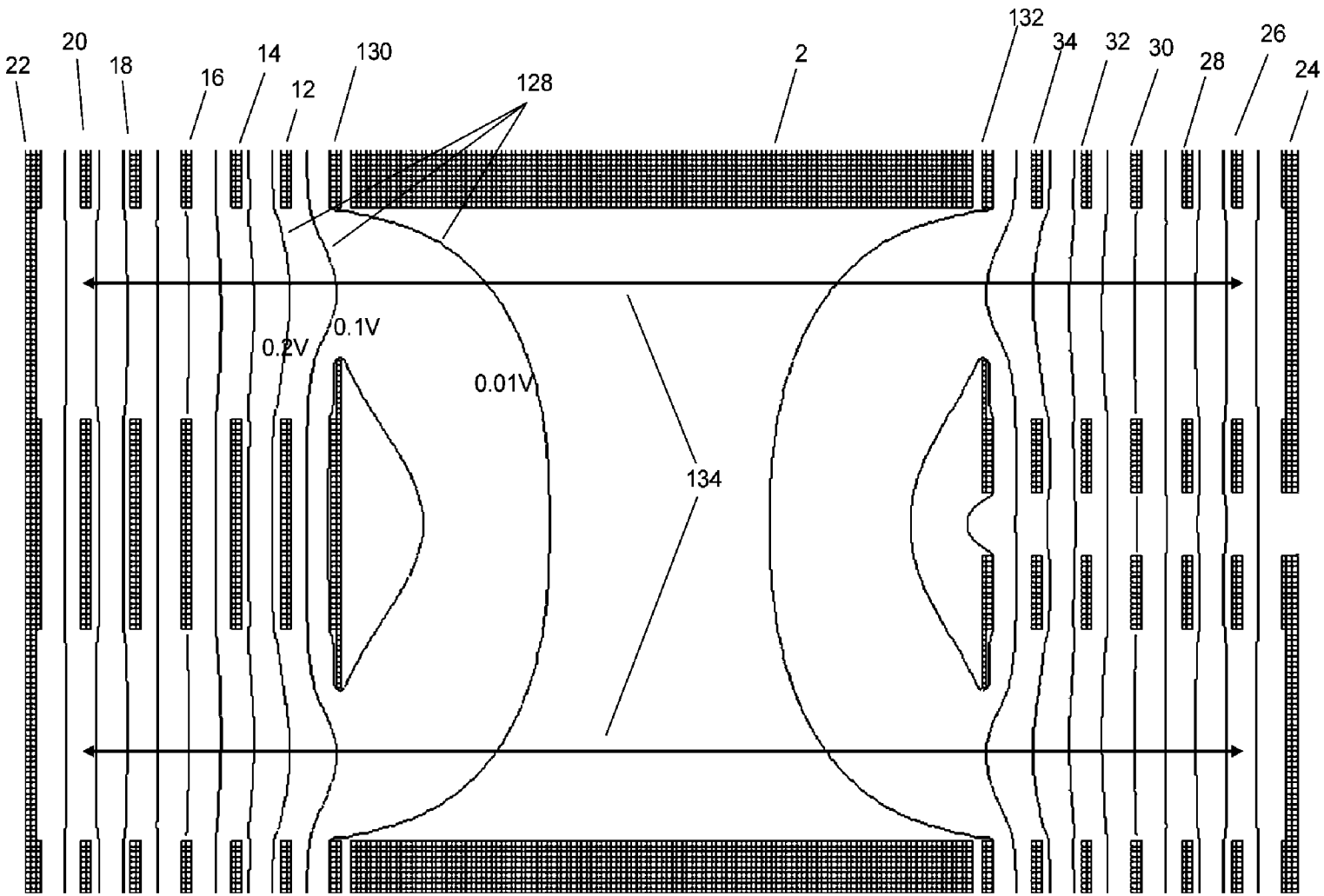
FIG. 7 depicts a simulation of an alternate embodiment reflecting ICR cell showing the equipotential lines during the detection of ions.

In yet a further alternate embodiment as depicted in FIG. 7, trapping plates 10 and 36 may be replaced with trapping plates 130 and 132 respectively, having larger inner diameters. The advantage of this embodiment is that it can accept ions of a broader range of cyclotron orbital radii. If the excitation process is not well controlled, ions may have a broader range of cyclotron radii or ions of differing m/z may have different cyclotron orbital radii. The disadvantage of this embodiment is that the larger gap between trapping plates 60 and 130 and between plates 38 and 132 produces a less ideal field during the ion detection step (step g). FIG. 7 depicts a simulation of the electric field of the cell according to this alternate embodiment. During the detection step the electrodes of plates 130 and 132 are held at ground potential. All other potentials are applied as described above with respect to FIG. 6. The equipotential surfaces of the so formed field are represented by lines 128. Notice the 0.01V equipotential surface extends further into cylinder 9 than the same equipotential surface in the embodiment of FIG. 6. Similar to the embodiment of FIG. 6, the excited ions in this alternate embodiment will follow a helical path on cylinder 134 between electrodes 22 and 24.

While the present invention has been described with reference to one or more preferred and alternate embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An FTICR mass analyzer having an ICR cell located in a homogeneous magnetic field having a field direction, the mass analyzer comprising:

a plurality of detection electrodes, each of which is positioned symmetrically about an axis which is aligned with the magnetic field direction;

a plurality of excitation electrodes, each of which is positioned symmetrically about the axis and arranged relative to the detection electrodes so that together, the detection electrodes and the excitation electrodes define a volume around the axis;

a trapping plate positioned symmetrically on said axis on either side of said excitation and detection electrodes, such that an application of repulsive electrical potentials to the trapping plates traps ions in the volume defined by the detection and excitation electrodes; and a set of reflecting electrodes positioned symmetrically on said axis adjacent to each trapping plate so that electric potentials applied to the reflecting electrodes form a homogeneous electrostatic field with substantially no radial component for reflecting ions into the volume defined by the detection and excitation electrodes.

2. The FTICR mass analyzer of claim 1 wherein each trapping plate is fabricated with a set of electrodes forming an infinity pattern.

3. The FTICR mass analyzer of claim 1 wherein one trapping plate includes sidekick electrodes.

4. The FTICR mass analyzer of claim 1 wherein each trapping plate comprises an inner trapping plate and an outer trapping plate, said inner trapping plate being substantially disk shaped, said outer trapping plate being substantially ring shaped, and said inner and outer trapping plates being coplanar and concentric forming a gap between said plates through which ions may pass.

5. The FTICR mass analyzer of claim 1 comprising more than two detection electrodes.

6. The FTICR mass analyzer of claim 1 wherein the set of reflecting electrodes comprises a disk shaped electrode positioned on said axis adjacent to a trapping plate.

7. The FTICR mass analyzer of claim 1 wherein the set of reflecting electrodes comprises a series of disk-shaped electrodes and a corresponding series of ring-shaped electrodes, each disk-shaped electrode being coplanar and concentric with a corresponding ring-shaped electrode forming a gap therebetween through which gap ions pass.

8. The FTICR mass analyzer of claim 7 wherein the series of disk-shaped electrodes and corresponding ring-shaped electrodes are evenly spaced along the axis adjacent to a trapping electrode.

9. The FTICR mass analyzer of claim 1 wherein each electrode in the set of reflecting electrodes is segmented into quadrants and at least some of the quadrants are capacitively coupled to the plurality of detection electrodes.

10. The FTICR mass analyzer of claim 1 wherein said reflecting electrodes are segmented into an even number of segments and wherein segments of reflecting electrodes which are adjacent to one another along said axis are capacitively coupled to one another such that coupled segments can be used collectively to detect ions.

11. A method of mass analyzing ions in mass analyzer that includes a reflecting ICR cell comprising:

a) generating ions;

b) introducing the ions into the reflecting ICR cell;

c) trapping the ions in the ICR cell by applying a trapping potential to a set of trapping electrodes;

d) exciting the trapped ions into cyclotron motion by applying an excitation waveform to at least one excitation electrode;

e) turning off the trapping potential;

f) applying reflecting potentials to a set of reflecting electrodes; and g) detecting the ions with at least one pair of detection electrodes.

12. The method of claim 11 wherein step (g) comprises detecting an unshifted ion cyclotron frequency.

13. The method of claim 11 wherein step (g) comprises detecting a harmonic of the ion cyclotron frequency.

14. The method of claim 11 wherein step (f) comprises applying an electrostatic reflecting field which substantially no radial component.

15. A method of mass analyzing ions in mass analyzer that includes a reflecting ICR cell comprising:

a) generating ions;

b) introducing the ions into the reflecting ICR cell;

c) trapping the ions in said ICR cell by applying trapping potentials with amplitudes to a set of trapping electrodes;

d) exciting trapped ions into cyclotron motion of approximately a predetermined radius by applying an excitation waveform to at least one excitation electrode;

e) reducing the amplitudes of the trapping potentials;

f) applying reflecting potentials to a set of reflecting electrodes; and g) detecting the ions with at least one pair of detection electrodes.

16. The method according to claim 15 wherein step (e) comprises reducing the amplitudes of the trapping potentials to ground potential.

* * * * *